US005613613A

United States Patent [19]

Ahorner

[11] Patent Number: 5,613,613

[45] Date of Patent: Mar. 25, 1997

[54] SIDE SEALING ARRANGEMENT FOR SIEVE DEVICES

[75] Inventor: Leander Ahorner, Waidhofen a.d. Ybbs, Austria

[73] Assignee: IFE Industrie-Einrichtungen Fertigungs-Aktiengesellschaft, Waidhofen a.d. Ybbs, Austria

[21] Appl. No.: 448,609

[22] PCT Filed: Oct. 7, 1994

[86] PCT No.: PCT/AT94/00147

§ 371 Date: Jun. 8, 1995

§ 102(e) Date: Jun. 8, 1995

[87] PCT Pub. No.: WO95/10367

PCT Pub. Date: Apr. 20, 1995

[30] Foreign Application Priority Data

Oct. 8, 1993 [DE] Germany ..... 93 5227 U

[51] Int. Cl.[6] ..... B07B 1/46

[52] U.S. Cl. ..... 209/310; 209/363; 209/399

[58] Field of Search ..... 209/310, 341, 209/363, 397, 398, 399, 401, 402, 403, 405

[56] References Cited

U.S. PATENT DOCUMENTS

| | | | |
|---|---|---|---|
| 3,363,769 | 1/1968 | Wilmot et al. | 209/405 X |
| 4,248,701 | 2/1981 | Wenzel | 209/310 X |
| 5,062,949 | 11/1991 | Hausmann | 209/310 |

FOREIGN PATENT DOCUMENTS

| | | | |
|---|---|---|---|
| 0206164 | 12/1986 | European Pat. Off. . | |
| 0209777 | 1/1987 | European Pat. Off. . | |
| 0277936 | 8/1988 | European Pat. Off. . | |
| 2108924 | 9/1972 | Germany . | |
| 2209721 | 9/1973 | Germany | 209/310 |
| 4022994 | 1/1991 | Germany . | |
| 9315227 | 2/1994 | Germany . | |

*Primary Examiner*—William E. Terrell
*Assistant Examiner*—Tuan Nguyen
*Attorney, Agent, or Firm*—Friedrich Kueffner

[57] ABSTRACT

A lateral seal for sieve devices with a grate having a plurality of grate bars which are alternately movable and immovable with respect to the side walls of the sieve device. Flexible sieve elements are fastened to the grate bars and extend across the gaps between the grate bars. The flexible sieve elements are moved or tensioned and relaxed by the movable grate bars. The lateral seal is formed of flexible material and is connected to the sieve elements and to the side walls. The lateral seal includes sealing leaves which overlap one another in an imbricated manner. Each sealing leaf extends in the sieving direction between two adjacent stationary grate bars.

4 Claims, 2 Drawing Sheets

FIG. 2
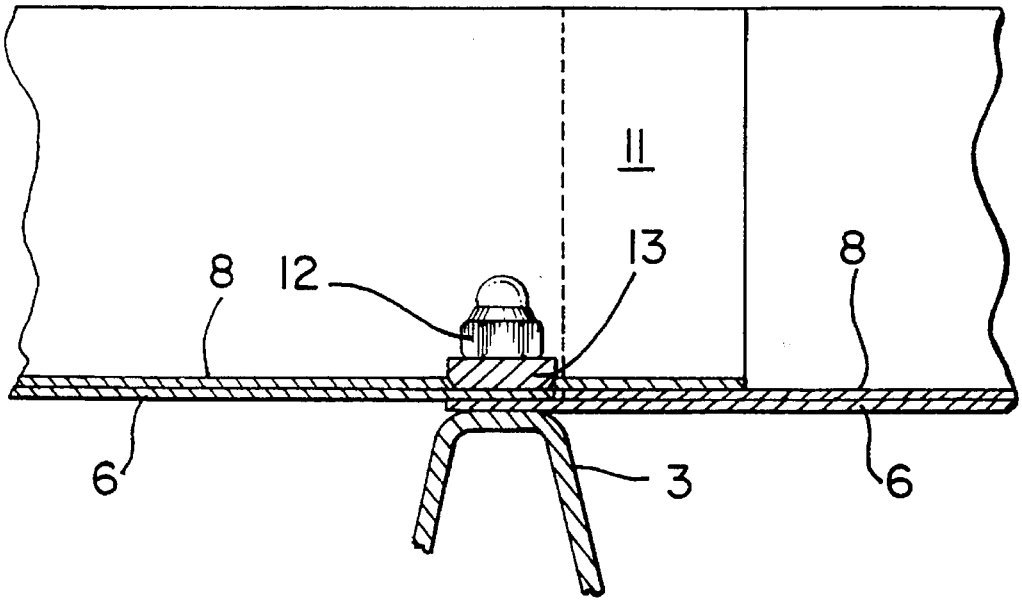
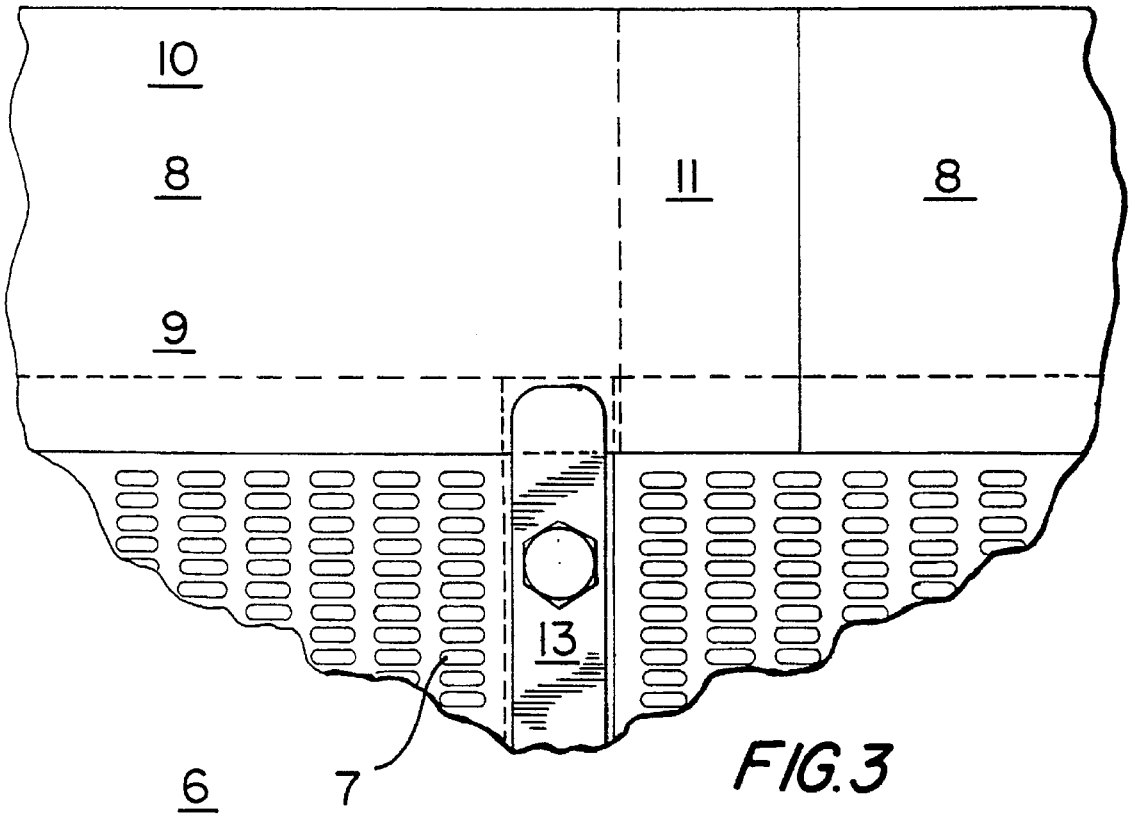
FIG. 3

SIDE SEALING ARRANGEMENT FOR SIEVE DEVICES

BACKGROUND OF THE INVENTION

1. Field of the Invention

The invention is directed to lateral seal for sieve devices with a grate having a plurality of grate bars which are alternately movable and immovable with respect to the side walls and which are connected by flexible sieve elements which are fastened to the grate bars and bridge the gaps between the grate bars and which are moved or tensioned and relaxed by the movable grate bars, wherein the lateral seal formed of flexible material is connected in a stationary manner with the sieve elements on the one hand and with side frame parts on the other hand.

2. Description of the Related Art

A lateral seal of this type is known, for instance, from AT-B-386 969 by the present applicant. In order to improve the sealing action, it is proposed that the lateral seal be formed of a series of sealing leaves overlapping one another in an imbricated manner, this overlapping preventing unwanted leakage of the sieved material.

There is also a completely different type of sieve seal for such sieve devices which is described, e.g., in DE-A1-28 13 630, which uses a resilient sealing body. This sealing body bridges the gap between the side wall and the sieve lining and is formed of a resilient foam plastic. Since such seals are subject to intensive wear in heavy-duty operation, in particular in the region of the grate bars which are movable relative to the side wall, it has been suggested in EP-B 0 206 164 to improve the life of these seals by constructing the sealing body from individual members of varying length, wherein, in the region of the movable grate bars, a short member is directly connected with the grate bar in each instance by means of a holder and the distance between these short members, which substantially corresponds to the distance between adjacent grate bars which are movable relative to the side wall, is bridged by a continuous longer member.

The present invention is directed to lateral seals of the type mentioned above which are formed of sealing leaves overlapping one another in an imbricated manner, wherein it is provided, according to the invention, to improve the sealing characteristics in that every sealing leaf, as viewed in the sieving direction, extends between two grate bars which are stationary relative to the side wall. The grate bars in question are preferably adjacent stationary grate bars so that only one movable grate bar is located between them.

As a result of the steps according to the invention, the starting end and terminating end of the sealing leaf are immovable relative to the side wall. Accordingly, on the one hand, two adjacent sealing leaves can abut simply by means of imbricated overlapping and on the other hand tightness is improved Further, the life of the lateral seal is substantially increased, since the mechanical fastening which is naturally exposed to the greatest stress at the edges is likewise arranged so as to be immovable so that localized dynamic loading is practically eliminated.

The movements produced by the movable grate bar approximately in the center of every sealing leaf can be distributed in a substantially improved manner by the leaf which is homogeneous at this location and can accordingly be withstood over a longer period of time than if such forces were introduced at the edges of the sealing leaf.

The invention is explained more fully with reference to the accompanying drawings.

BRIEF DESCRIPTION OF THE DRAWINGS

FIG. 2 shows an enlarged view of the fastening of the end of sealing leaf similar to the view in FIG. 1;

FIG. 3 shows a top view according to arrow III in FIG. 2 with folded-up sealing leaves.

DESCRIPTION OF THE PREFERRED EMBODIMENT

Figure 1:
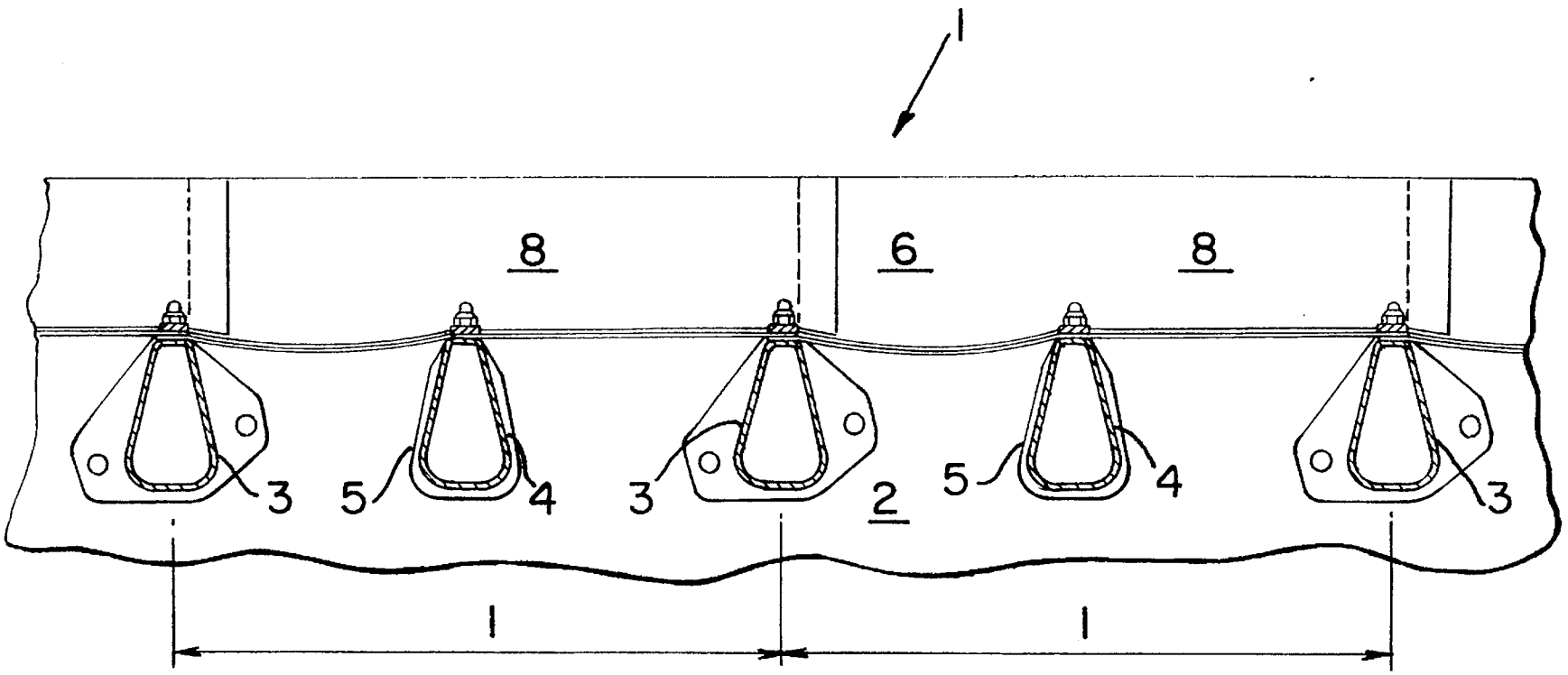
FIG. 1 shows a side view of a sieve provided with a lateral seal according to the invention, partially in section.

FIG. 1 shows a sieve machine 1 with a side wall 2 to which the grate bars 3 are fastened so as to be immovable.

A movable grate bar 4 is provided between every two adjacent grate bars 3. The grate bars 4 project through openings 5 of the side wall 2 and are set in circular, elliptical or linear reciprocating motion by a movement mechanism external to the side wall 2. This movement can also be effected in an up and down direction or can correspond to a rotating-tilting motion around an axis extending parallel to the bar axis.

It is essential only that a sieve lining 6, which in most cases of application is formed of individual sections, be alternately tensioned and relaxed by the movement of the movable grate bars 4 so that the sieved material located on the sieve lining 6 moves and the undersized material passes out through openings 7 in the sieve lining 6.

Naturally, a gap exists between the lateral edge of the sieve lining 6 and the side wall 2 which must be covered so as to prevent oversized material from falling through and accordingly reducing sieving quality.

This lateral sealing is effected by means of sealing leaves 8 which are connected, preferably glued, along their lower edge regions with the lateral edge region of the sieve lining 6. The upper edge regions 10 of the sealing leaves 8 parallel thereto are attached to the side wall 2 of the sieve device, e.g., by clamping strips or also by gluing. For the sake of better understanding, the arrangement is shown in FIG. 3 with the sealing leaves 8 folded away and, consequently, with the side wall 2 omitted.

Arrow F in FIGS. 2 and 3 indicates the transporting direction which determines the manner of imbricated overlapping of the sealing leaves 8. It is important to note that the overlapping region 11 of the two sealing leaves 8 between the two edge regions 9, 10 is not glued, so that the two sealing leaves in this region can carry out a relative movement with respect to one another.

FIG. 2 shows a more precise view of the fastening of the sealing leaves 8 at the respective sieve elements 6. The sieve element 6 situated upstream of the stationary grate bar 3 ends in the region of this grate bar immediately below its fastening member at the grate bar which, in the present example, is a cap nut 12 which is placed upon and screwed onto a threaded bolt of the grate bar 3 so that a fastening strip 13 presses the individual sieve elements 6 against the grate bar 3.

Since the downstream sieve element 6 is arranged below the upstream sieve element in order to prevent material from passing through, a gap occurs downstream of the upper sieve element 6 between the sealing leaf 8 glued to this sieve element and the sieve element 6 situated downstream. The downstream sealing leaf 8 is inserted into this gap and glued with the downstream sieve element 6. It is not necessary to glue the two sealing leaves 8 together in this region, although this can be done.

The sieve elements 6 and sealing leaves 8 can bridge an optional multiple of the distance between two adjacent immovable grate bars, but they preferably extend only from an immovable grate bar to the next immovable grate bar as is shown in FIG. 1.

The leaf-like sealing elements can be formed of any material conventionally used for this purpose. Under certain circumstances, lower qualities can be used if an extended useful life cannot be achieved, e.g., due to wear of the sieve lining, so as to reduce costs. On the other hand, if the useful life is the determining factor, a substantial increase in the useful life can be achieved without increasing costs by retaining the material of the sealing leaf.

The fastening between the sieve element 6 and the sealing leaf 8 need not be effected by gluing, but rather can also be carried out by riveting, screwing or the like, although gluing is preferred.

As will be seen from FIG. 3, the sealing leaves 8 in this example are connected with the sieve elements 6 at the outside so that a trough shape with smooth, rounded corners occurs in cross section when the sealing leaves are set upright. Of course, it is possible, as is shown in AT-B-386 969 which was cited above, to connect the sealing leaves with the sieve linings 6 so as to lie on the inside of these sieve linings 6 so that an outwardly directed point is formed when the sealing leaves are set upright. When curved in this way, the sealing leaves 8 are capable of withstanding large deformations better than in the shown variant.

I claim:

1. A lateral seal for a sieve device for sieving material in a sieving direction, the sieving device comprising a grate and side walls, the grate comprising a plurality of stationary grate bars and movable grate bars mounted so as to be movable relative to the side walls, gaps being defined between the grate bars, flexible sieve elements being fastened to the grate bars and extending across the gaps between the grate bars, such that the flexible sieve elements are tensioned and relaxed by the movable grate bars, the lateral seal being comprised of flexible material and being fixedly connected to the sieve elements and the side walls, the lateral seal comprising sealing leaves which overlap one another in an imbricated manner, wherein each sealing leaf extends in the sieving direction between two adjacent stationary grate bars.

2. The lateral seal according to claim 1, comprising at least one sealing leaf extending between two adjacent stationary grate bars, wherein only one movable grate bar is mounted between the two adjacent stationary grate bars.

3. The lateral seal according to claim 1, wherein, in a region of each stationary grate bar in which two sealing leaves join one another, the sealing leaf located downstream in the sieving direction substantially extends to an end of the sieve element located upstream, so that the imbricated overlapping by the upstream sealing leaf is effected in such a way that the upstream sealing leaf extends substantially in a planar manner in a horizontal portion thereof.

4. The lateral seal according to claim 1, comprising glued connections between the sieve elements and the sealing leaves.

* * * * *

UNITED STATES PATENT AND TRADEMARK OFFICE

CERTIFICATE OF CORRECTION

PATENT NO. : 5,613,613

DATED : March 25, 1997

INVENTOR(S) : Leander Ahorner

It is certified that error appears in the above-identified patent and that said Letters Patent is hereby corrected as shown below:

On the Title page, item [30] should read as follows:

[30] Foreign Application Priority Data

Oct. 8, 1993 [DE] Germany.....93 15 227 u

Signed and Sealed this

Twentieth Day of January, 1998

*Attest:*

*Attesting Officer*

BRUCE LEHMAN

*Commissioner of Patents and Trademarks*